United States Patent [19]

Zilver

[11] 3,931,846

[45] Jan. 13, 1976

[54] BRAKES FOR CORDS

[75] Inventor: Edwin Zilver, Doorwerth, Netherlands

[73] Assignee: Silverflex Internationaal N.V.

[22] Filed: Apr. 26, 1974

[21] Appl. No.: 464,303

[52] U.S. Cl. ..... 160/178

[51] Int. Cl.[2] ..... E06B 3/92

[58] Field of Search ..... 160/166–178, 160/178 C; 24/115 R, 115 D, 115 J

[56] References Cited

UNITED STATES PATENTS

| | | | |
|---|---|---|---|
| 296,169 | 4/1884 | Hill et al. | 24/115 D |
| 764,047 | 7/1904 | French | 160/178 C |
| 2,645,283 | 7/1953 | Johansson | 160/176 |

FOREIGN PATENTS OR APPLICATIONS

| | | | |
|---|---|---|---|
| 4,871 | 12/1877 | United Kingdom | 160/178 C |

*Primary Examiner*—Paul R. Gilliam
*Assistant Examiner*—P. Kannan
*Attorney, Agent, or Firm*—Norris & Bateman

[57] ABSTRACT

In a brake for the pull-cord of a blind in which the cord is fed between, and in engagement with, a braking surface and a freely movable clamping body which, in one direction of movement of the cord, serves to clamp the cord against the braking surface, the braking surface forms part of the tapered interior of a housing through which the cord is passed and the clamping body is a circular disc or sphere of a diameter which is smaller than the widest part and greater than the narrowest part of the tapered interior, less the thickness of the cord, and is prevented from falling out of the widest part by a stop member secured therein.

2 Claims, 5 Drawing Figures

BRAKES FOR CORDS

The invention relates to a brake for a cord, provided with a movable clamping body and a braking surface, the cord being fed between the braking surface and the clamping body.

With such cord-brakes it is of great importance, if cord-wear is to be minimised, that no sharp edges or the like are used. Moreover it is necessary that the brake can, on the one hand, be reliably put into operation and on the other hand, released smoothly and without difficulties.

Furthermore, many of such brakes require to be of extremely small dimensions, e.g., when they have to be mounted on brackets for roller blinds, venetian blinds and the like.

Furthermore, it is of importance that such brakes are of such shape, that mass production is possible, without burrs occurring in those parts of the brake which engage the cord.

The invention provides a solution to the above mentioned problems which in practice has proved to be very efficacious, by making the braking surface part of a housing formed with an internal tapering portion, making the clamping body circular in section and of a diameter which is smaller than the widest part of the tapering portion of the housing and greater than the narrowest part of said portion, reduced by the thickness of the cord, and providing a stop member at the widest part of said tapering portion of the housing to prevent the clamping body from leaving.

In order to ensure that the clamping member cannot leave the housing at the narrowest part thereof when no cord is present, it is provided, according to a further feature of the invention, that the diameter of the circular section is greater than the width of the smallest part of the tapered portion of the housing.

In one embodiment of the invention which is particularly preferred when only one brake is required, the clamping member is a sphere and the housing is of frusto-conical shape.

In a further embodiment of the invention, the clamping member is a flat disc and the housing is provided with two parallel sides and two convergent sides.

The latter embodiment is particularly preferred when either the space available for the brake is relatively small, or a number of brakes have to be housed in a limited space.

The invention is illustrated, merely by way of example, in the accompanying drawings, in which.

Figure 1:
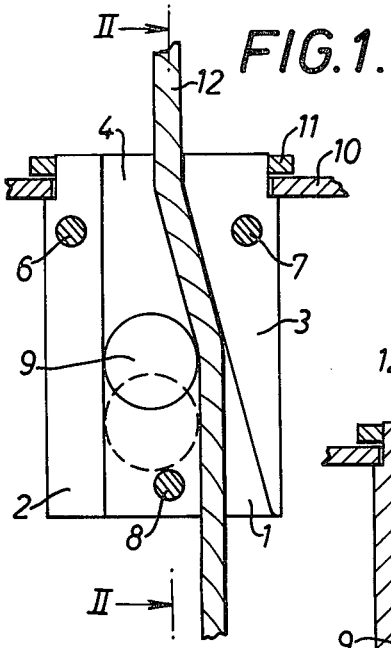
FIG. 1 shows one embodiment of the invention in section along the line I—I of FIG. 2.
Figure 2:
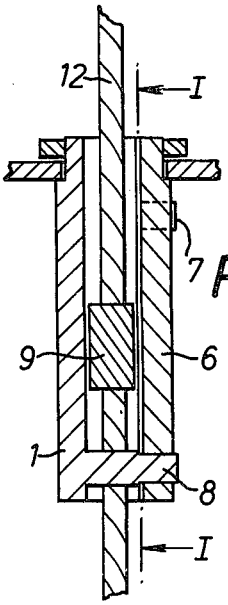
FIG. 2 is a section along the line II—II of FIG. 1.

The brake shown in FIGS 1 and 2 substantially comprises two housing portions 1 and 5, portion 1 of which is provided with raised sections 2 and 3, the inner surfaces of said sections converging upwardly towards each other to define a tapering inner space 4. Portion 1 also carries three pins, 6, 7 and 8. The portion 5, in the form of a cover, ismounted on portion 1 and rests on the sections 2 and 3, said cover portion 5 being retained by the pins 6, 7 and 8. Furthermore, a loose circular disc 9 is provided between the sections 2 and 3, which disc 9 has a diameter somewhat larger than the smallest distance between the sections 2 and 3 and smaller than the largest distance between said sections. Pin 8 is so mounted that disc 9 cannot fall out of the wider end of the space 4.

The pins can be mounted in any suitable manner, e.g., by means of screwing, glueing, upsetting and so on.

It is also possible to freely select the material of the parts already described and both metal and synthetic materials can be employed. As schematically indicated in FIGS. 1 and 2, the whole construction is mounted in a plate 10, e.g., by means of a clamping member 11. A pull cord is indicated at 12.

When, in the position shown, an upwardly directed pull is exerted on cord 12 disc 9 rolls upwardly to press the cord 12 harder and harder against section 3 until the braking force exerted thereby is greater than the pull force exerted on the cord, and the brake is in the "on" position. If, on the other hand, a slight downard pull is exerted on the cord the latter moves a little to the right, disc 9 drops to the position indicated in dotted lines and the cord can be moved freely either up or down. To put the brake into operation again, the cord is moved temporarily to the left and allowed to run out a little during which period, it moves upward and disc 9 is taken along with it again until braking action is complete.

Figure 3:
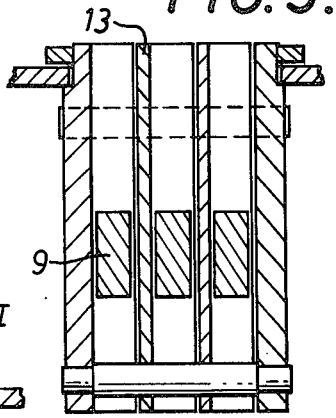
FIG. 3 shows the combination of a number of brakes of the type shown in FIGS. 1 and 2.

FIG. 3 shows an embodiment of the invention, in which, a number of brakes are mounted side by side and separated by partitions 13 which are well-supported by the sections 2 and 3 (vide FIG. 1) and can therefore, be relatively thin. It should be pointed out that in the drawing the brake is shown on a considerably enlarged scale and that in practice a total height of the order of 15 to 22 mms has proved to be entirely satisfactory.

Figure 4:
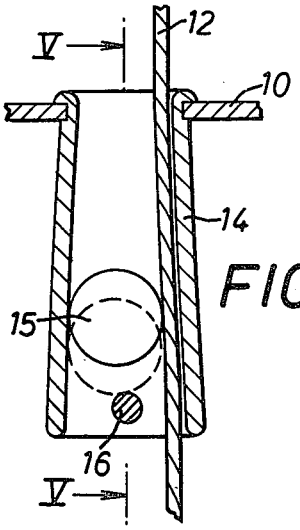
FIG. 4 shows a section through a further embodiment of the invention.
Figure 5:
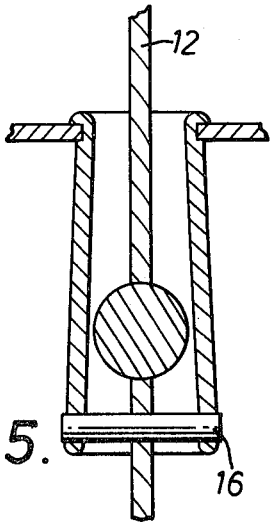
FIG. 5 shows a section along the line V—V of FIG. 4.

In the embodiment shown in FIGS 4 and 5 the brake surface is formed by the inner wall of the frustum of a cone 14. Said cone is suitably mounted in a wall, which, in conformity with FIGS. 1–3 inclusive, is indicated by 10. The cone contains a sphere 15 having a diameter somewhat greater than the inner diameter of the upper end of the cone. A pin 16 is passed through the wider lower end of the cone and prevents the sphere from falling out.

If the pull cord, which is again indicated by 12, is kept in contact with the sphere and then allowed to run upward, a clamping action between the inner wall of the sphere and the cord occurs, by which said cord is prevented from moving further in the upward direction. If the cord is lowered for a very short period of time the sphere will drop until it reaches the position indicated in dotted lines in which the cord can freely be moved up and down. The brake can be re-applied by moving the cord a little to the left as looked at in FIG. 4, to engage the sphere and then letting the cord run upward.

The brake according to the invention has proved in practice, to be not only extremely simple, but also very efficacious. It is of importance that the cord need not be fed around guide rolls or passed over angled members but can be moved in a substantially straight line. However, it is within the scope of the invention to guide the cord over angled members if desired. Mounting the cord in the brake is extremely simple when disc 9 or sphere 15 is in its lowermost position. A further advantage is that the various parts can be manufactured, e.g. by moulding, without burrs being formed on the surfaces which can contact the cord, which means that removing of burrs, which in practice, is still necessary with some known forms of brake, can be avoided.

I claim:

1. A brake for a cord comprising a movable clamping body surface and a relatively fixed braking surface between which surfaces the cord is fed and selectively clamped, characterized in that the braking surface is the inner wall of an open ended housing of frusto-conical shape and the clamping body is a sphere that is loosely mounted within the housing and is of a diameter which is smaller than the widest part of the housing and greater than the narrowest part of said housing reduced by the thickness of the cord, and a stop member mounted in the widest part of said housing to prevent the sphere from leaving the housing.

2. A brake according to claim 1, characterized in that the stop member is a pin traversing the widest part of the housing.

* * * * *